US006128971A

United States Patent [19]

Papasideris

[11] Patent Number: 6,128,971

[45] Date of Patent: Oct. 10, 2000

[54] CONTROL DEVICE

[75] Inventor: Stamos I. Papasideris, Bristol, Ill.

[73] Assignee: Caterpillar Inc., Peoria, Ill.

[21] Appl. No.: 09/217,219

[22] Filed: Dec. 21, 1998

[51] Int. Cl.[7] ..... G05G 13/00

[52] U.S. Cl. ..... 74/471 XY; 74/471 R

[58] Field of Search ..... 74/471 XY, 469, 74/471 R

[56] References Cited

U.S. PATENT DOCUMENTS

| | | | |
|---|---|---|---|
| 3,978,738 | 9/1976 | Naulin | 74/471 XY |
| 4,046,005 | 9/1977 | Goroski | 73/133 |
| 4,587,510 | 5/1986 | Kim | 74/471 XY |
| 4,748,441 | 5/1988 | Brzezinski | 340/709 |
| 5,655,411 | 8/1997 | Avitan et al. | 74/471 XY |
| 5,749,268 | 5/1998 | Nishimura | 74/471 XY |
| 5,809,841 | 9/1998 | Smith | 74/531 |
| 5,857,492 | 1/1999 | Salamun | 74/471 XY |
| 5,875,682 | 3/1999 | Smith | 74/471 R |

*Primary Examiner*—David M. Fenstermacher
*Attorney, Agent, or Firm*—Marla L. Hudson

[57] ABSTRACT

A control device for a machine has a control lever operative to rotate about two axes. The control lever is rotatably mounted on a shaft within a frame and is in communication with a first rotation sensor to detect movement of the control lever about the first axis. A first pair of adjustable abutment members are operative to center the control lever within the frame. The control lever and frame are operative to rotate about the second axis. A second rotation sensor is operative to detect movement of the control lever about the second axis. A second pair of adjustable abutment members are operative to center the control lever and frame within a stationary housing.

18 Claims, 3 Drawing Sheets

CONTROL DEVICE

TECHNICAL FIELD

This invention relates generally to a control device and more particularly to a control device having a control lever and adjustable centering mechanisms.

BACKGROUND ART

In the field of work machines, particularly those machines which perform digging or loading functions such as excavators, backhoe loaders, and wheel loaders, the work implements are generally manually controlled with various operator controls in addition to other machine function controls. The manual control system often includes foot pedals as well as hand operated levers. There are several areas in which these types of implement control schemes can be improved to alleviate operator stress and fatigue resulting from the manipulation of multiple levers and foot pedals. For example, a machine operator is required to manipulate and coordinate the multitude of control levers and foot pedals proficiently. To become productive, an inexperienced operator requires a long training period to become familiar with the controls and associated functions.

Some manufacturers recognize the disadvantages of having too many control levers and have adopted multifunctional control levers as the norm. A multifunctional control lever is an extremely desirable mechanism particularly for controlling lift and tilt functions on a machine having an implement such as a blade or bucket attached to lift linkage.

The difficulties encountered with some multifunctional control levers, as well as some single function control levers, is the consistent repeatability of the control lever returning to the center or neutral position when the operator releases his or her input from the lever. If the control lever does not consistently return to the center or neutral position, the operator may experience unwanted drift or movement of the linkage or implement. Having the control lever consistently return to center is critical for accurate positioning of the linkage and attached implement as well as for providing a reliable reference point for the operator.

Additionally, it is desirable to have a multifunctional control lever that not only consistently returns to the center position but also provides some resistive feedback to the operator. Furthermore, it is also desirable to have a multifunctional control lever that provides at least one detent position for controlling a machine function. Still further, it desirable to have a control lever that is easily preset to the center or neutral position before installation on a machine and is readily adjustable while installed on the machine.

The present invention is directed to overcoming one or more of the problems set forth above.

DISCLOSURE OF THE INVENTION

In one aspect of the present invention, a control device for a machine is disclosed. The control device includes a control lever that is rotatably mounted on a shaft within a frame. The shaft is disposed along a first axis and is rotatable thereabout. A pair of abutment members are defined by the control lever and a first pair of centering levers are mounted on the shaft on opposite sides of the control lever. The first pair of centering levers are operative to rotate relative to one another about the first axis in response to rotation of the control lever. A pair of adjustable abutment members are defined by the centering levers and are operative to engage the control lever abutment members. A pair of abutment stop portions are located on the centering levers with the abutment stop portions being operative to engage a pair of stop members located on the frame. At least one first biasing mechanism is connected between each centering lever and opposing sides of the frame. Each first biasing mechanism is operative to bias each centering lever against the respective stop members located on the frame.

BEST MODE FOR CARRYING OUT THE INVENTION

Figure 1:
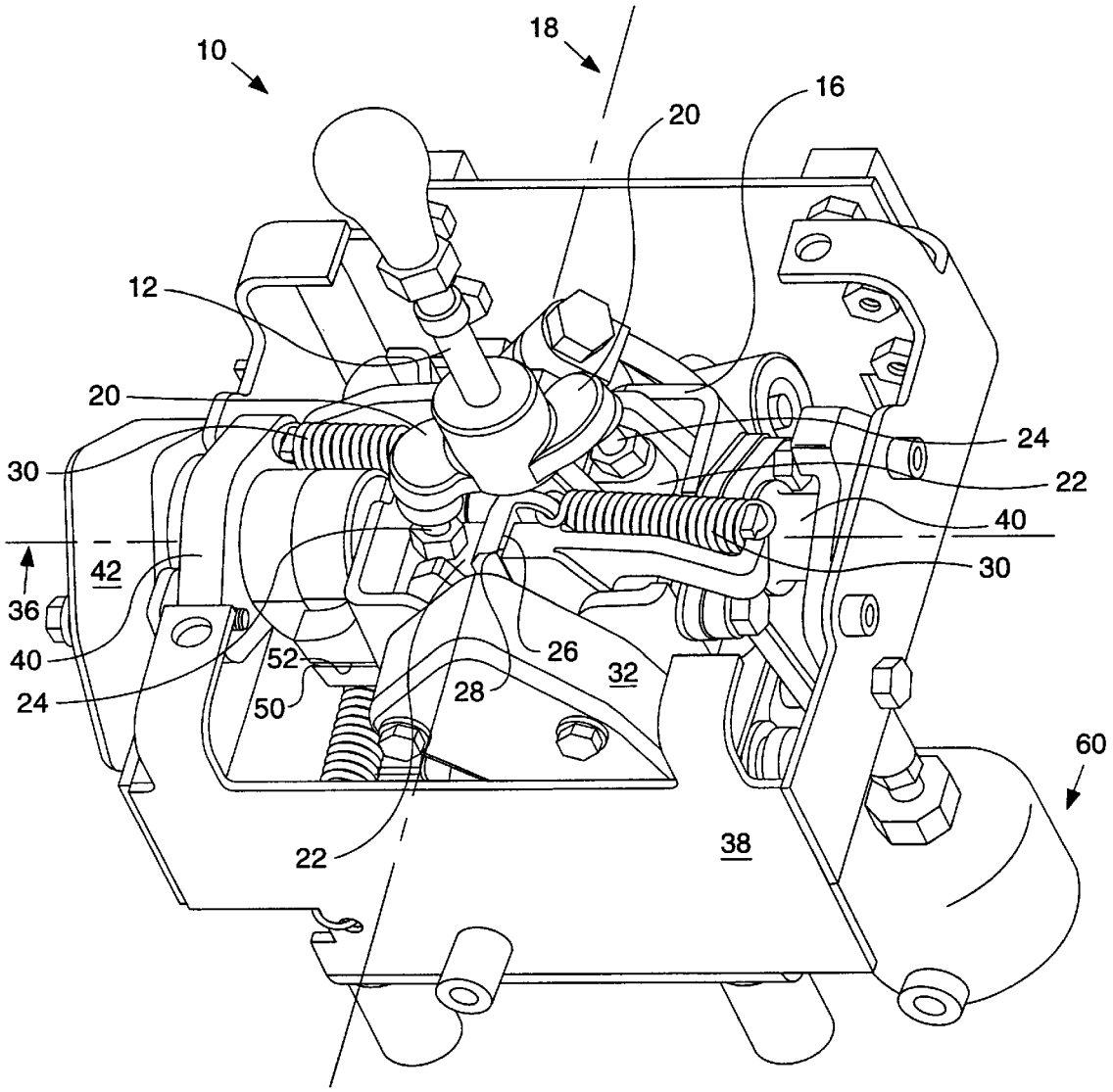
FIG. 1 is a diagrammatic perspective view of the control device of the present invention.
Figure 3:
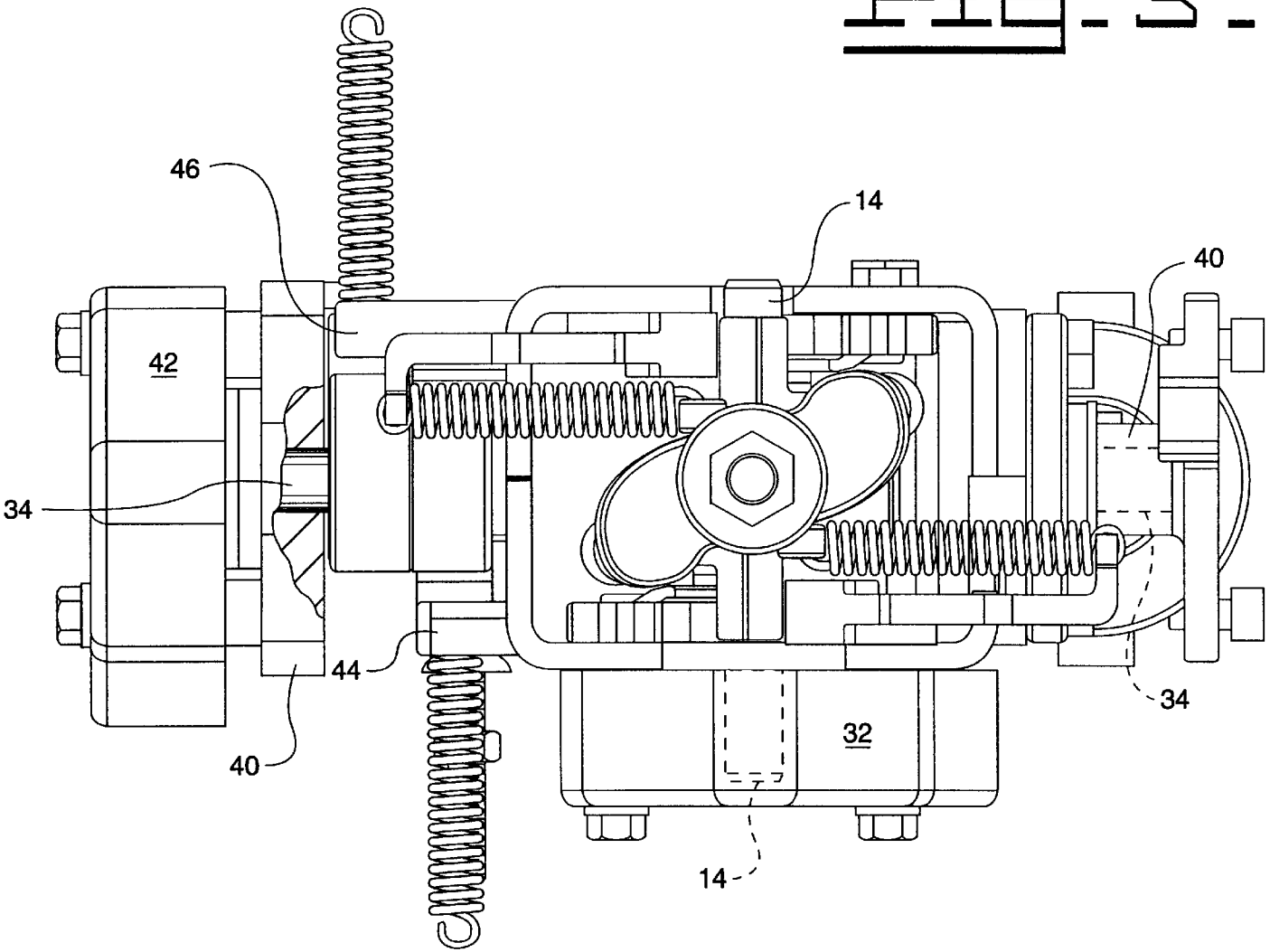
FIG. 3 is a diagrammatic top view of the control device of FIG. 2.

Referring to the drawings and more particularly to FIGS. 1 and 3, a control device 10 for a machine (not shown) has a control lever 12 rotatably mounted on a shaft 14 within a frame 16. The shaft 14 is disposed along a first axis 18 and is rotatable thereabout. A pair of abutment members 20 are defined by the control lever 12 on opposite sides thereof. A first pair of centering levers 22 are mounted on the shaft 14 on opposite sides of the control lever 12. The first pair of centering levers 22 are operative to rotate relative to one another about the first axis 18 in response to rotation of the control lever 12.

A first pair of adjustable abutment members 24 are defined by the first pair of centering levers 22. The first pair of adjustable abutment members 24 are operative to engage the control lever abutment members 20.

A pair of abutment stop portions 26 (one shown in FIG. 1) are located on the first pair centering levers 22 and are operative to engage a first pair of stop members 28 (one shown in FIG. 1) located on the frame 16. At least one first biasing mechanism 30 is connected between each first centering lever 22 and opposing sides of the frame 16. Each first biasing mechanism 30 is operative to bias each first centering lever 22 against the respective first stop members 28 located on the frame 16. The first biasing mechanism 30 includes a spring connected between each first centering lever 22 and the frame 16.

The control device 10 has a first rotation sensor 32 connected at one end of the shaft 14 to detect movement of the control lever 12 about the first axis 18. The first rotation sensor 32 is operative to control a first machine function, for example, an implement tilt function. It is to be understood that such a function is only mentioned by way of example and not a limitation.

The frame 16 has a pair of cylindrical extensions 34 disposed along a second axis 36. The cylindrical extensions 34 extend outwardly from opposite ends of the frame 16 toward a stationary housing 38. Each cylindrical extension 34 is operative to engage a receptacle 40 formed in the stationary housing 38. It is noted that the receptacle 40 need not be an integral feature of the stationary housing 38 but could be a separate component attached to the stationary housing 38 without departing from the essence of the invention.

The control device 10 includes a second rotation sensor 42 connected at one end of one of the cylindrical extensions 34. The second rotation sensor 42 is operative to detect movement of the control lever 12 about the second axis 36 and is operative to control a second machine function such as linkage lift function.

The control device 10 also includes first and second extension members 44,46 defined by the frame 16. The first and second extension members 44,46 extend from the frame 16 in the same direction and are spaced apart from one another so as to be positioned on opposite sides of the second axis 36.

Figure 2:
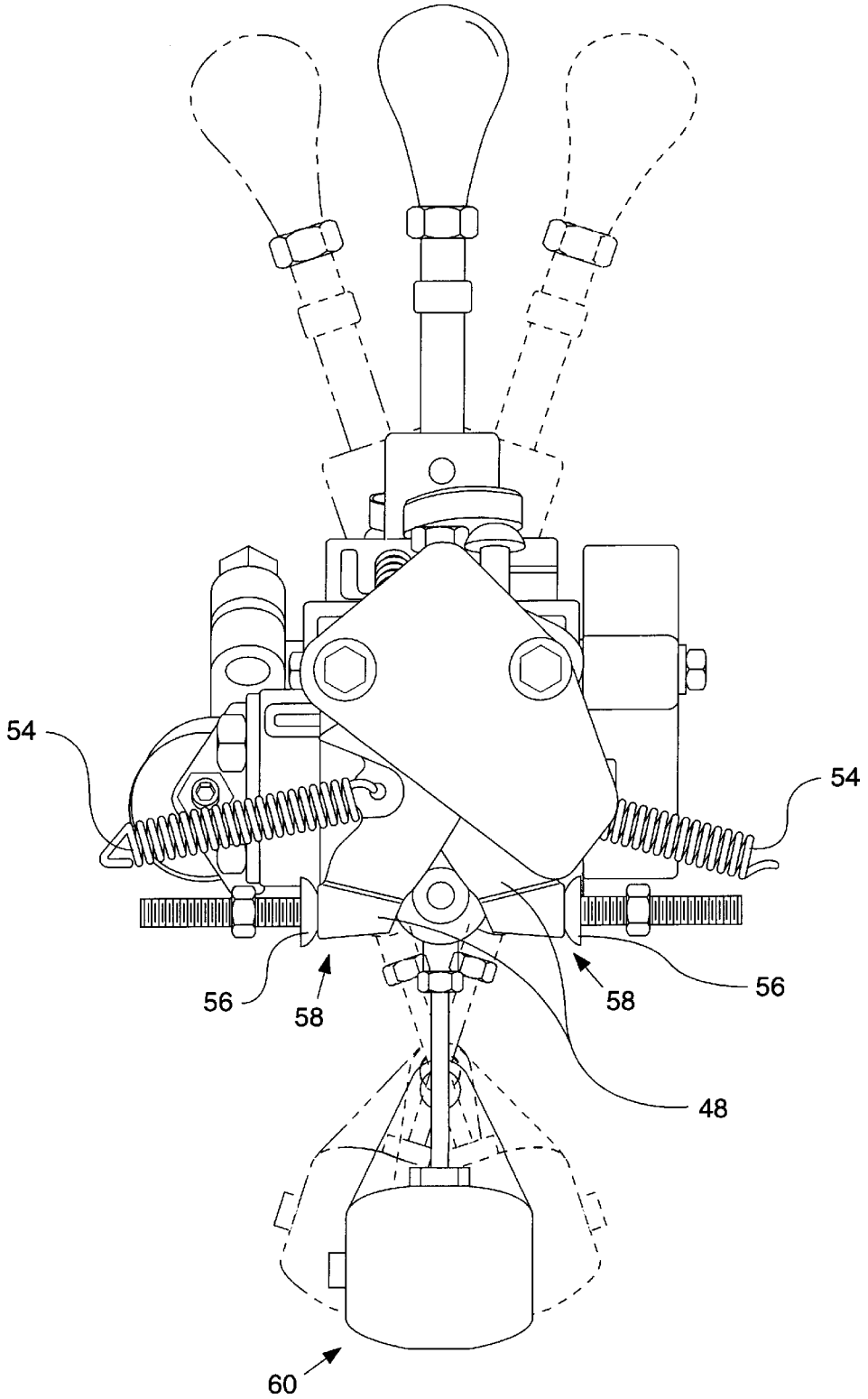
FIG. 2 is a diagrammatic side view of the control device of FIG. 1 with the housing removed.

As best shown in FIGS. 1 and 2, a second pair of centering levers 48 are mounted on one of the cylindrical extensions 34. Each of the second pair of centering levers 48 are operative to rotate about the second axis 36 and to rotate relative to one another. Each of the second pair of centering levers 48 defines a first abutment surface 50 that engages a respective abutment surface 52 defined on the first and second extension members 44,46 of the frame 16. At least one second biasing mechanism 54 is connected between each of the second pair of centering levers 48 and opposing sides of the stationary housing 38. Each second biasing mechanism 54 is operative to bias each of the second pair of centering levers 48 against the respective abutment surfaces 52 located on the first and second extension members 44,46 of the frame 16. Each second biasing mechanism 54 includes a spring connected between each second centering lever 48 and the stationary housing 38.

A second pair of adjustable abutment members 56 extend from the stationary housing 38 and engage a distal end portion 58 of each of the respective second pair of centering levers 48. The second pair of adjustable abutment members 56 are operative to center the second pair of centering levers 48 and therefore the frame 16 and lever 12 mounted therein with respect to the stationary housing 38.

The control device 10 further includes a detent mechanism 60 which is operative to hold the control lever 12 in a rotated position about one of the first or second axes 18,36. Additionally, a plurality of detent mechanisms 60 may be used to hold the control lever 12 in a rotated position about each of the first and second axes 18,36. A mechanical detent mechanism 60 may be used for holding the control lever 12 in a rotated position about the first or second axes 18,36 while an electromagnetic detent mechanism may be used to hold the control lever 12 in any of various rotated positions about the first or second axes 18,36. Preferably, each respective detent mechanism 60 is operative to hold the control lever 12 in a first and second rotated position about the respective axes 18,36.

INDUSTRIAL APPLICABILITY

A typical application for the control device 10 is to control multiple machine functions such as implement tilt and linkage lift functions on a wheel loader. For example, an operator grasps the control lever 12 and rotates it from the center or neutral position about the first axis 18 to execute an implement tilt function such as bucket dump or rack back. As the control lever 12 is rotated in a first direction about the first axis 18, one of the abutment members 20, defined by the control lever 12, applies a downward force on the respective adjustable abutment member 24 and consequently causes rotation of one of the first pair of centering levers 22. The rotational force applied to the control lever 12 works against the biasing force of one of the springs of the first biasing mechanism 30 which gives the operator some degree of resistive feedback. As one of the first centering levers 22 is rotated against the biasing force of one of the springs of the first biasing mechanism 30, the first centering lever 22 is removed from contact with the respective first stop member 28. Additionally, rotation of the control lever 12 causes the shaft 14 to rotate which provides an input to the first rotation sensor 32. The first rotation sensor 32 responsively communicates an output signal to a control module for controlling a machine function such as bucket tilt or rack back.

When the operator releases the control lever 12, the spring force of the first biasing mechanism 30 pulls the rotated first centering lever 22 back into contact with the respective first stop member 28. As the first centering lever 22 is returned into contact with the respective stop member 28, the first adjustable abutment member 24 pushes upward on the abutment member 20 of the control lever 12, bringing the control lever 12 back to the center or neutral position. In the center or neutral position, the abutment members 20 of the control lever 12 are in contact with the respective first adjustable abutment members 24 of the first centering levers 22 while the abutment stop portions 25 of the first centering levers 22 are in contact with the respective first stop members 28 of the frame 16.

Adjustment of the control lever 12 to the center or neutral position with respect to the first axis 18 is readily achieved by adjustment of the first adjustable abutment members 24. Gauging the center or neutral position of the control lever 12 can be achieved by using feedback from the first rotation sensor 32 or by using a lever centering gauge attached to the stationary housing 38, or by visual inspection of the position of the control lever 12 and the resulting stability or lack of drift of the implement and/or linkage from its respective position.

As a practical example of utilizing the control device 10 to control a second machine function, the operator rotates the control lever 12 from the center or neutral position about the second axis 36 to execute a lift or lower function of the implement linkage. As the control lever 12 is rotated about the second axis 36, the frame 16 rotates within the stationary housing 38 while the cylindrical extensions 34 of the frame 16 rotate within the respective receptacles 40 of the stationary housing 38. The rotational force applied to the control lever 12 by the operator is transferred through one of the first or second extension members 44,46 of the frame 16, depending on the direction of rotation, to cause rotation of one of the second centering levers 48. The respective abutment surface 52 of one of the first or second extension members 44,46 contacts the respective abutment surface 50 of the second centering levers 48. Rotation of the control lever 12 works against the biasing force of one of the respective springs of the second biasing mechanism 54 while an input is provided to the second rotation sensor 42 due to rotation of the cylindrical extensions 34. The second rotation sensor 42 responsively communicates an output signal to the control module for controlling a machine function such as linkage lift or lower.

When the operator releases the control lever 12, the spring force of the second biasing mechanism 54 pulls the distal end portion 58 of the rotated second centering lever 48 back into contact with the respective second adjustable stop member 56. As the second centering lever 48 is returned into contact with the respective second adjustable stop member 56, the abutment surface 50 on the respective second centering lever 48 pushes upward on the respective abutment surface 52 of the respective first or second extension members 44,46, bringing the control lever 12 and the frame 16 back to the center or neutral position.

Adjustment of the control lever 12 to the center or neutral position with respect to the second axis 36 is readily achieved by adjustment of the second adjustable abutment members 56. Gauging the center or neutral position of the control lever 12 can be achieved by using feedback from the second rotation sensor 42 or by using a lever centering gauge attached to the stationary housing 38, or by visual inspection of the position of the control lever 12 and the resulting stability or lack of drift of the implement and/or linkage from its respective position.

The control device 10 may be equipped with the detent mechanism 60 to hold the control lever 12 in a rotated position about each and any of the first and second axes 18,36. Various types of detent mechanisms may be used such as mechanical, electromagnetic, hydro-mechanical or any other variation thereof. The preferred detent mechanism 60 is operative to hold the control lever 12 in a first and second rotated position about the respective axes 18,36.

Other aspects, objects and advantages of this invention can be obtained from a study of the drawings, the disclosure and the appended claims.

I claim:

1. A control device for a machine, comprising:

a control lever rotatably mounted on a shaft within a frame, the shaft being disposed along a first axis and rotatable thereabout;

a pair of abutment members defined by the control lever on opposite sides thereof;

a first pair of centering levers mounted on the shaft on opposite sides of the control lever, the first pair of centering levers being operative to rotate relative to one another about the first axis in response to rotation of the control lever;

a first pair of adjustable abutment members defined by the centering levers, the first pair of adjustable abutment members being operative to engage the control lever abutment members;

a pair of abutment stop portions located on the centering levers, the abutment stop portions being operative to engage a first pair of stop members located on the frame; and at least one first biasing mechanism connected between each centering lever and opposing sides of the frame, each first biasing mechanism being operative to bias each centering lever against the respective first stop members located on the frame.

2. The control device, as set forth in claim 1, including a first rotation sensor connected at one end of the shaft to detect movement of the control lever about the first axis.

3. The control device, as set forth in claim 2, wherein the first rotation sensor is operative to control a first machine function.

4. The control device, as set forth in claim 1, wherein the frame has a pair cylindrical extensions disposed along a second axis, the cylindrical extensions extending outwardly from opposite ends of the frame.

5. The control device, as set forth in claim 4, including a stationary housing and wherein each cylindrical extension is operative to engage a receptacle formed in the stationary housing.

6. The control device, as set forth in claim 4, including a second rotation sensor connected at one end of one of the cylindrical extensions to detect movement of the control lever about the second axis.

7. The control device, as set forth in claim 6, wherein the second rotation sensor is operative to control a second machine function.

8. The control device, as set forth in claim 4, including a plurality of detent mechanisms being operative to hold the control lever in a rotated position about each of the first and second axes.

9. The control device, as set forth in claim 4, including a detent mechanism being operative to hold the control lever in a rotated position about one of the first and second axes.

10. The control device, as set forth in claim 9, wherein one detent mechanism is operative to hold the control lever in a first and second rotated position about the first axis.

11. The control device, as set forth in claim 9, wherein one detent mechanism is operative to hold the control lever in a first and second rotated position about the second axis.

12. The control device, as set forth in claim 9, wherein the detent mechanism is a mechanical detent mechanism.

13. The control device, as set forth in claim 9, wherein the detent mechanism is an electromagnetic detent mechanism.

14. The control device, as set forth in claim 1, including first and second extension members defined by the frame, the first and second extension members extend from the frame in the same direction and are spaced apart from one another so as to be positioned on opposite sides of the second axis.

15. The control device, as set forth in claim 14, including a second pair of centering levers mounted on one of the cylindrical extensions, each centering lever being operative to rotate about the second axis and to rotate relative to the other centering lever.

16. The control device, as set forth in claim 15, wherein each of the second pair of centering levers defines a first abutment surface that engages a respective abutment surface defined on the first and second extension members of the frame.

17. The control device, as set forth in claim 16, including at least one second biasing mechanism connected between each of the second pair of centering levers and opposing sides of the stationary housing, each second biasing mechanism being operative to bias each of the second pair of centering levers against the respective abutment surfaces located on the first and second extension members of the frame.

18. The control device, as set forth in claim 15, including a second pair of adjustable abutment members that extend from the stationary housing and engage a distal end portion of each of the respective second pair of centering levers to center the second pair of centering levers and therefore the frame and lever mounted therein with respect to the stationary housing.

* * * * *